US009565504B2

(12) United States Patent
Miyata et al.

(10) Patent No.: US 9,565,504 B2
(45) Date of Patent: Feb. 7, 2017

(54) SPEAKER DEVICE

(75) Inventors: Satoshi Miyata, Kobe (JP); Hiroshi Kubota, Kobe (JP)

(73) Assignee: TOA Corporation, Hyogo (JP)

( * ) Notice: Subject to any disclaimer, the term of this patent is extended or adjusted under 35 U.S.C. 154(b) by 140 days.

(21) Appl. No.: 14/408,961

(22) PCT Filed: Jun. 19, 2012

(86) PCT No.: PCT/JP2012/065586

§ 371 (c)(1),
(2), (4) Date: Feb. 5, 2015

(87) PCT Pub. No.: WO2013/190632

PCT Pub. Date: Dec. 27, 2013

(65) Prior Publication Data

US 2015/0139430 A1 May 21, 2015

(51) Int. Cl.
*H04R 29/00* (2006.01)
*H04R 3/12* (2006.01)

(52) U.S. Cl.
CPC ..... *H04R 29/00* (2013.01); *H04R 29/002* (2013.01); *H04R 3/12* (2013.01)

(58) Field of Classification Search
None
See application file for complete search history.

(56) References Cited

U.S. PATENT DOCUMENTS 3,732,370 A * 5/1973 Sacks ..... H03G 5/025 333/28 T
2006/0251265 A1 11/2006 Asada
2011/0026743 A1 2/2011 Lowe et al.
2013/0058492 A1* 3/2013 Silzle ..... H04R 5/027 381/59

FOREIGN PATENT DOCUMENTS

| | | | |
|---|---|---|---|
| EP | 1715724 | A2 | 10/2006 |
| EP | 2229006 | A1 | 9/2010 |
| JP | 07-087590 | A | 3/1995 |
| JP | 2004-297368 | A | 10/2004 |
| JP | 2006-254115 | A | 9/2006 |
| JP | 2008-154130 | A | 7/2008 |

OTHER PUBLICATIONS

International Search Report prepared for corresponding International Patent Application No. PCT/JP2012/065586 dated Jul. 24, 2012 (2 pages).

* cited by examiner

*Primary Examiner* — Joseph J Nguyen
*Assistant Examiner* — Kenny Truong
(74) *Attorney, Agent, or Firm* — Kilyk & Bowersox, P.L.L.C.

(57) ABSTRACT

To provide a speaker apparatus that can detect miswiring to a speaker unit or trouble of a speaker unit itself. The speaker apparatus is configured to include: two or more speaker units 11 that are arranged in a speaker housing 10; a sensor microphone 12 that is arranged in the speaker housing 10 and outputs a sound collection signal 6; a target unit selection part 20 that selects any one of the speaker units 11 as a target unit; a sound signal supply part 21 that supplies an external sound signal 4 to the target unit; and an error detection part 25 that provides an error output on the basis of the external sound signal 4 and the sound collection signal 6.

5 Claims, 7 Drawing Sheets

(a) case of the notch filter (b) case of the narrow BPF (a) test signal (b) impulse response

SPEAKER DEVICE

This application is a National Stage Application of PCT/JP2012/065586, filed Jun. 19, 2012.

TECHNICAL FIELD

The present invention relates to a speaker apparatus, and more specifically, to improvement of a speaker apparatus in which two or more speaker units are arranged in a speaker housing.

BACKGROUND ART

Speaker systems in which multiple speaker units are arranged in a speaker housing include one called an array speaker apparatus, which is sometimes used as a broadcast facility. As the array speaker apparatus, there is one that can control directivity of a sound wave by providing a delay circuit for each of speaker units and on a sound signal supplied to the speaker units, adjusting a delay time for each of the speaker units (e.g., Patent Literature 1).

The respective speaker units of the above-described array speaker apparatus emit the same sound waves while producing slight time differences, and therefore even in the case where some of the speaker units are in failure, the failure cannot be easily realized. For example, even in the case where some of the speaker units are in failure, and thereby abnormality occurs in the directivity of the array speaker apparatus, the abnormality cannot be found unless an observation is made at a listening point where abnormal sound pressure occurs. Also, even in the case where the failure is realized from a reduction in sound level, or the like, it is not easy to specify which of the speaker units is in failure.

Meanwhile, as an array speaker apparatus incorporating a power amplifier that amplifies a sound signal to supply the amplified signal to a speaker unit, there is known one that can detect overcurrent or overvoltage occurring in an amplifier circuit, or a temperature rise of a circuit element. However, such failure detection utilizing a detecting function of the power amplifier itself has a problem of being unable to detect miswiring to the speaker unit or trouble of the speaker unit itself.

For example, in the case of an array speaker apparatus that adjusts a delay of a sound signal with a DSP (Digital Signal Processor), the DSP adjusts a delay time for each of channels corresponding to unit attachment positions on a speaker housing. For this reason, respective speaker units should be connected to the channels corresponding to the positions on the speaker housing; however, failure detection utilizing a power amplifier cannot detect misconnection between the DSP and a speaker unit. Also, in the case where a speaker unit is a unit using cone paper as a diaphragm, failure detection utilizing a power amplifier cannot detect a tear of the cone paper.

CITATION LIST

Patent Literature

Patent Literature 1: Japanese Unexamined Patent Publication JP-A07-87590

SUMMARY OF INVENTION

Technical Problem

In the case of using an array speaker apparatus as a broadcast facility, it is desirable to be able to detect the failure of a speaker unit without interrupting broadcasting after installation of the array speaker apparatus. However, among conventional array speaker apparatuses, there is no array speaker apparatus that can detect the failure of a speaker unit during broadcasting.

Also, among conventional array speaker apparatuses that adjust a delay of a sound signal for each channel, there is no array speaker apparatus that can detect a trouble such as a speaker unit being connected to a wrong channel.

The present invention is made in consideration of the above situations, and an object of the present invention is to provide a speaker apparatus that can detect the trouble of a speaker unit. In particular, the object is to provide a speaker apparatus that can detect miswiring to a speaker unit, or trouble of a speaker unit itself.

Also, another object of the present invention is to provide a speaker apparatus that can detect the failure of a speaker unit without interrupting sound emission. Further, still another object of the present invention is to provide a speaker apparatus that can detect the failure of a speaker unit during broadcasting as well as preventing erroneous detecting from occurring due to the influence of background noise.

Still further, still another object of the present invention is to provide a speaker apparatus that can detect the trouble of a speaker unit itself as well as also detecting miswiring to a speaker unit. Yet further, still another object of the present invention is to provide a speaker apparatus that can detect miswiring to a speaker unit as well as improving the accuracy of directivity control.

Means of Solving Problem

A speaker apparatus according to a first aspect of the present invention is configured to include: two or more speaker units that are arranged in a speaker housing; a sensor microphone that is arranged in the speaker housing and outputs a sound collection signal; target unit selection means adapted to select at least one of the speaker units as a target unit; sound signal supply means adapted to supply an input sound signal to the target unit; and error detecting means adapted to provide an error output on the basis of the input sound signal and the sound collection signal.

In such a configuration, since the sensor microphone is arranged in the speaker housing in which the multiple speaker units are arranged, collecting sounds emitted from the speaker units makes it possible to detect the trouble of a speaker unit.

A speaker apparatus according to a second aspect of the present invention is, in addition to the above configuration, configured to include: a band elimination filter that attenuates a frequency component in a test band, and thereby generates a non-target sound signal from the input sound signal; a first bandpass filter that attenuates a frequency component in a band other than the test band, and thereby generates a reference sound signal from the input sound signal; and a second bandpass filter that attenuates the frequency component in the band other than the test band, and thereby generates a detection sound signal from the sound collection signal, in which: the sound signal supply means supplies the input sound signal to the target unit and also supplies the non-target sound signal to speaker units other than the target unit; and the error detecting means makes a comparison between the detection sound signal and the reference sound signal, and on the basis of a result of the comparison, provides the error output.

In this speaker apparatus, a sound containing the frequency component in the test band is emitted from the target unit, whereas from speaker units other than the target unit, a sound of which the frequency component in the test band is attenuated is emitted. In addition, the error output is provided by making a comparison between the test band of the input sound signal and that of the sound collection signal. That is, in this speaker apparatus, the trouble of the target unit is detected using the fact that the frequency component in the test band is emitted only from the target unit when supplying the input sound signal and the non-target sound signal to the speaker units. For this reason, without interrupting sound emission based on the input sound signal, the failure of a speaker unit can be detected. That is, in the case of using such a speaker apparatus for a broadcast facility, the failure of a speaker unit can be detected during broadcasting. In addition, since the test band of the input sound signal and that of the sound collection signal are compared with each other, the trouble of a speaker unit itself can be detected.

A speaker apparatus according to a third aspect of the present invention is, in addition to the above configuration, configured to include power level determination means adapted to make a determination as to whether or not a power level of the reference sound signal is a certain level or more, in which the error detecting means provides the error output on the basis of a result of the determination by the power level determination means.

In such a configuration, depending on whether or not the power level of the reference sound signal obtained by attenuating the frequency component in the band other than the test band from the input sound signal is the certain level or more, the error output is provided. For this reason, it can be prevented that in the case where a power level of the input sound signal in the test band is low, the sound collection signal in the test band is buried in noise due to the influence of background noise, and thereby the failure of the target unit is erroneously detected. Accordingly, the failure of a speaker unit can be detected during broadcasting, and also erroneous detection can be prevented from occurring due to the influence of background noise.

A speaker apparatus according to a fourth aspect of the present invention is, in addition to the above configuration, configured to include: a low tone unit and a high tone unit as the speaker units, which respectively have different sound ranges, in which any of the band elimination filter, the first bandpass filter, and the second bandpass filter can switch between a first test band included in the sound range of the low tone unit and a second test band included in the sound range of the high tone unit, and on the basis of a result of selecting the target unit, switches between the first and second test bands.

In such a configuration, by switching the test band depending on whether the target unit is the low tone unit or the high tone unit, failure can be detected even in the case where the target unit is any of the low tone unit and the high tone unit.

A speaker apparatus according to a fifth aspect of the present invention is, in addition to the above configuration, configured to include: test signal generation means adapted to generate a test impulse signal as the input sound signal; delay time detection means adapted to detect a delay time of an impulse response to the impulse signal on the basis of the sound collection signal; and transmission distance calculation means adapted to obtain a sound wave transmission distance between the target unit and the sensor microphone on the basis of the delay time, in which the error detecting means provides the error output on the basis of the sound wave transmission distance.

In this speaker apparatus, since the test impulse signal is generated as the input sound signal, the error output is provided on the basis of the sound collection signal obtained when supplying the impulse signal to the target unit. For this reason, by analyzing the sound collection signal, the trouble of a speaker unit itself can be detected.

Also, the delay time of the impulse response to the impulse signal is detected, and the sound wave transmission distance between the target unit and the sensor microphone is obtained from the delay time to detect the trouble of the target unit. That is, by specifying the position of the target unit on the speaker housing from the sound waved transmission distance, misconnection between the sound signal supply means and a speaker unit can be detected.

A speaker apparatus according to a sixth aspect of the present invention is, in addition to the above configuration, configured such that the sensor microphone is arranged on an extended line of an array formed by the speaker units.

In such a configuration, even in the case of selecting any of the speaker units as the target unit, the position of the target unit can be specified from the sound wave transmission distance, and therefore detecting accuracy when detecting miswiring to a speaker unit can be improved.

A speaker apparatus according to a seventh aspect of the present invention is, in addition to the above configuration, configured to include: an external input terminal to which an external sound signal is input; directivity control means adapted to supply the external sound signal to the speaker units and also adjust a delay time of the external sound signal for each of the speaker units; physical distance storage means adapted to retain a physical distance between the target unit and the sensor microphone; and sound velocity error calculation means adapted to obtain a sound velocity error on the basis of a difference between the sound wave transmission distance and the physical distance, in which the directivity control means corrects the delay time on the basis of the sound velocity error.

In this speaker apparatus, by supplying the external sound signal inputted to the external input terminal to the speaker units, and also adjusting the delay time of the external sound signal for each of the speaker units, directivity is controlled. When doing so, the accuracy of the directivity control can be improved by obtaining the sound velocity error from the difference between the sound wave transmission distance obtained by emitting the test impulse signal from the target unit and the physical distance between the target unit and the sensor microphone, and correcting the delay time.

A speaker apparatus according to an eighth aspect of the present invention is, in addition to the above configuration, configured to include: power level calculation means adapted to perform a Fourier transformation of the sound collection signal to obtain a frequency-dependent power level; and frequency characteristic storage means adapted to, as an impulse response characteristic of the target unit with respect to the impulse signal, retain a frequency characteristic including a frequency-dependent power level, in which the error detecting means makes a comparison between the frequency-dependent power level obtained by the power level calculation means and the frequency characteristic, and on the basis of a result of the comparison, provides the error output.

In this configuration, since the frequency characteristic obtained from the sound collection signal when emitting the test impulse signal from the target unit and the preliminarily retained frequency characteristic are compared with each other, and then the error output is provided, the trouble of a speaker unit itself can be surely detected.

Advantageous Effects of Invention

In the speaker apparatus according to the aspects of the present invention, since the sensor microphone is arranged in the speaker housing in which the multiple speaker units are arranged, the trouble of a speaker unit can be detected. In particular, miswiring to a speaker unit, or trouble of a speaker unit itself can be detected.

Also, in the speaker apparatus according to the aspects of the present invention, the error output is provided using the fact that the frequency component in the test band is emitted only from the target unit when supplying the input sound signal or the non-target sound signal to the respective speaker units, and therefore without interrupting sound emission, the failure of a speaker unit can be detected. Further, the failure of a speaker unit can be detected, and in addition, erroneous detection can be prevented from occurring due to the influence of background noise.

Still further, in the speaker apparatus according to the aspects of the present invention, the trouble of a speaker unit can be detected, and in addition, miswiring to a speaker unit can also be detected. Yet further, miswiring to a speaker unit can be detected, and in addition, the accuracy of directivity control can be improved.

DESCRIPTION OF EMBODIMENTS

Embodiment 1

<Sound Amplification System 100>

Figure 1:
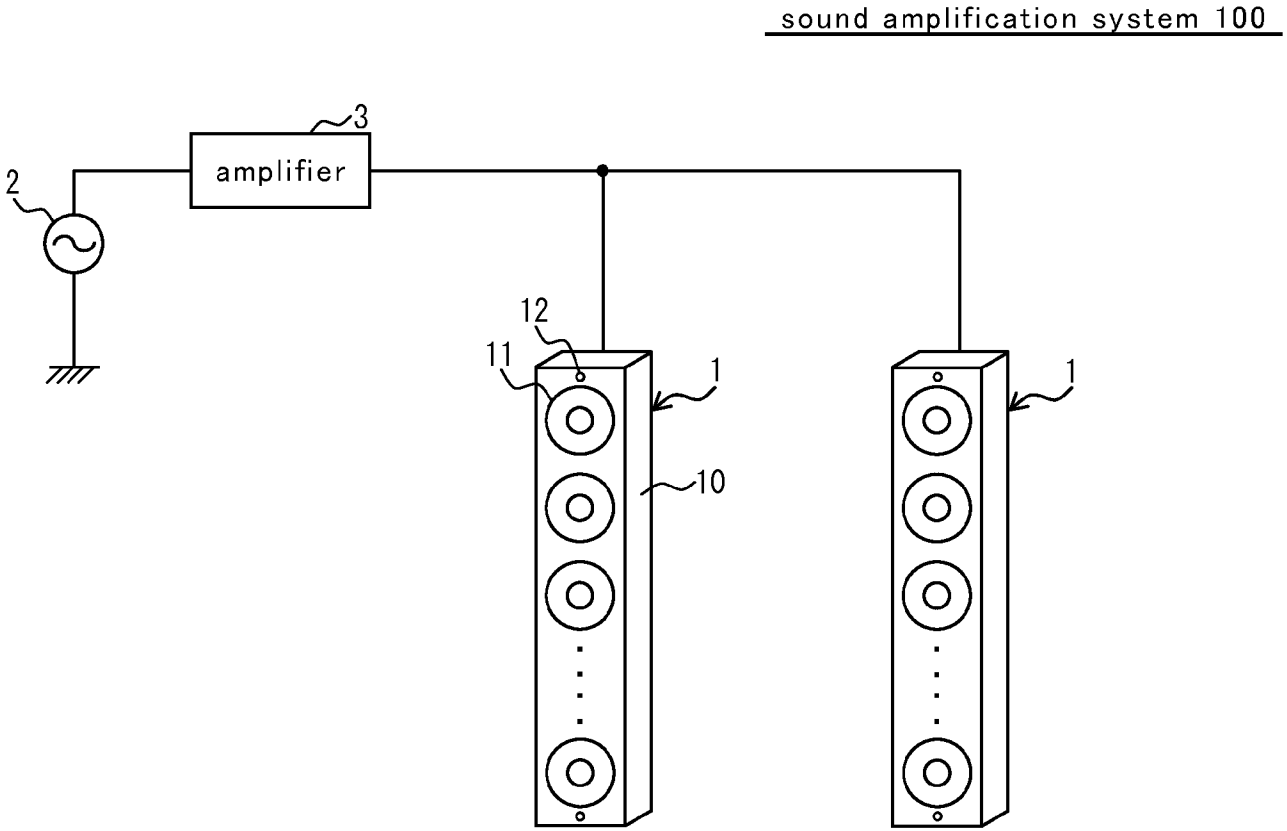
FIG. 1 is a system diagram illustrating a configuration example of a sound amplification system 100 including array speaker apparatuses 1 according to Embodiment 1 of the present invention.

FIG. 1 is a system diagram illustrating a configuration example of a sound amplification system 100 including array speaker apparatuses 1 according to Embodiment 1 of the present invention. The sound amplification system 100 is configured to include the two array speaker apparatuses 1, signal source 2, and amplifier 3, in which a broadcast signal generated in the signal source 2 is amplified by the amplifier 3, and the amplified broadcast signal is transmitted to the respective array speaker apparatuses 1.

For example, in the case of using a microphone as the signal source 2, a sound collection signal including frequency components in an audio band is generated in the microphone, and after amplified by the amplifier 3, transmitted to the respective array speaker apparatuses 1 as the broadcast signal. That is, the broadcast signal collected by the microphone is transmitted to the respective array speaker apparatuses 1, and inputted as an external sound signal. The respective array speaker apparatuses 1 output broadcast sounds on the basis of the inputted broadcast signal.

An array speaker apparatus 1 is a speaker system including a speaker housing 10, two or more speaker units 11, and two sensor microphones 12, and can control the directivity of the broadcast sound by adjusting a delay of the broadcast signal.

A speaker unit 11 is a loudspeaker device adapted to convert a sound signal such as the broadcast signal into a sound wave. For example, in the case of a dynamic type speaker unit, the speaker unit 11 is configured to include a diaphragm such as cone paper and a voice coil for vibrating the diaphragm.

The speaker housing 10 is a rectangular parallelepiped-shaped box body called an enclosure. The respective speaker units 11 are arranged in the speaker housing 10 in an array. For example, the respective speaker units 11 are arranged in the front surface of the speaker housing 10 one-dimensionally or two-dimensionally.

In the array speaker apparatus 1, the speaker housing 10 is formed in a vertically long shape, in which the three or more speaker units 11 are linearly arranged. That is, the respective speaker units 11 are arrayed in the longer direction of the speaker housing 10.

The sensor microphones 12 are microphones adapted to collect a sound wave from the speaker units 11, and the array speaker apparatus 1 includes the at least one sensor microphone 12. The sensor microphone 12 is, to make distances from the respective speaker units 11 mutually different, arranged on one end side farther than a speaker unit 11 arranged at one end of the array formed by the speaker units 11.

To describe specifically, the sensor microphone 12 is arranged in the extension of the array of the speaker units 11, for example, near an end part of the front surface of the speaker housing 10. Arranging two or more sensor microphones 12 in the speaker housing 10 makes it possible to improve the accuracy of failure detection.

Installing such an array speaker apparatus 1 in a vertically long state makes it possible to control the directivity in the elevation/depression angle direction (vertical direction). For example, a directivity angle in the vertical direction can be widened or narrowed. Also, a directivity direction in the vertical direction can be controlled. Installing the array speaker apparatus 1 in a horizontally long state makes it possible to control the directivity in the azimuth angle direction (horizontal direction) in the completely same manner. For example, a directivity angle in the horizontal direction can be widened or narrowed. Also, a directivity direction in the horizontal direction can be controlled.

<Array Speaker Apparatus 1>

Figure 2:
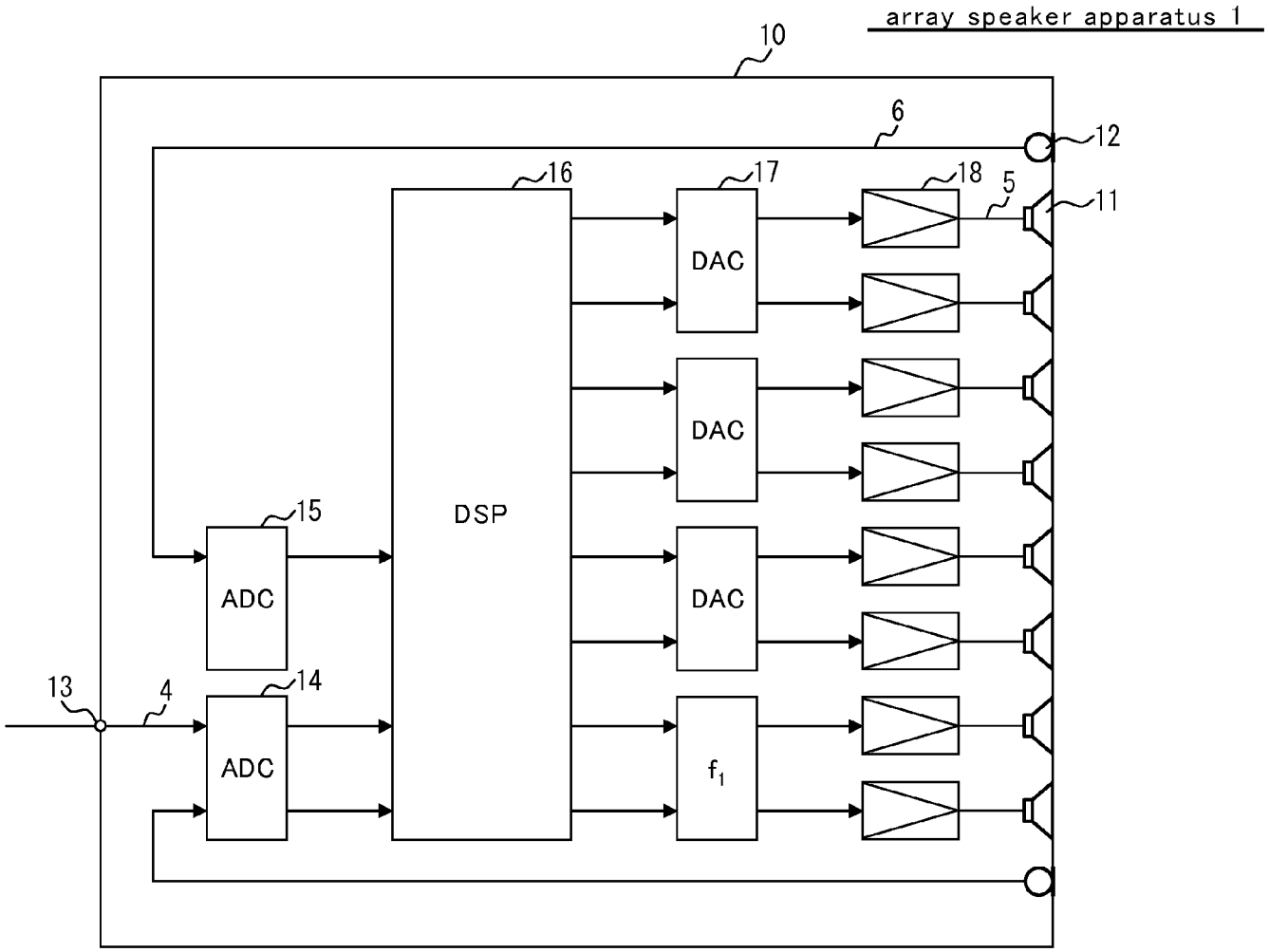
FIG. 2 is a diagram illustrating a configuration example of an array speaker apparatus 1 in FIG. 1.

FIG. 2 is a diagram illustrating a configuration example of an array speaker apparatus 1 in FIG. 1. This diagram illustrates an array speaker apparatus 1 that includes eight speaker units 11 and eight power amplifiers 18. This array speaker apparatus 1 is configured to include a broadcast terminal 13, ADCs 14 and 15, a DSP 16, and DACs 17.

The broadcast terminal 13 is an external input terminal to which an external sound signal 4 is inputted, and arranged in the speaker housing 10. The ADCs (analog-digital converters) 14 and 15 are both conversion elements adapted to convert an analog signal to a digital signal, each of which is provided with input terminals and output terminals corresponding to two channels.

The ADC 14 samples the external sound signal 4 inputted via the broadcast terminal 13 with a predetermined period to convert the external sound signal 4 into digital data, and outputs the digital data to the DSP 16, as well as also, in the same manner as for the external sound signal 4, converting a sound collecting signal 6 inputted from the sensor microphone 12 into digital data, and outputting the digital data to the DSP 16. As with the ADC 14, the ADC 15 converts a sound collection signal 6 inputted from the sensor microphone 12 into digital data, and outputs the digital data to the DSP 16.

The DSP 16 is a signal processing part that adjusts a delay of the external sound signal 4 and performs failure detection on the speaker units 11 on the basis of the sound collection signal 6. In the case of supplying the external sound signal 4 inputted to the broadcast terminal 13 to the respective DACs 17, the DSP 16 adjusts a delay time of the external sound signal 4 for each of the speaker units 11, and thereby controls the directivity of the broadcast sound. Also, the DSP 16 has channels corresponding to unit attachment positions on the speaker housing 10 or to positions in the array of the speaker units 11, and adjusts the delay time for each of the channels.

A DAC (digital-analog converter) 17 is a conversion element adapted to convert a digital signal to an analog signal, and provided with input terminals and output terminals corresponding to two channels. A DAC 17 converts the sound signal inputted from the DSP 16 to an analog signal, and outputs the analog signals to a corresponding power amplifier 18.

A power amplifier 18 is an amplifier that amplifies the sound signal inputted from a corresponding DAC 17, and thereby generates a speaker drive signal 5 for driving a corresponding speaker unit 11. A power amplifier 18 is provided for each of the speaker units 11, and can adjust a volume level of the broadcast sound for each of the speaker units 11.

<DSP 16>

Figure 3:
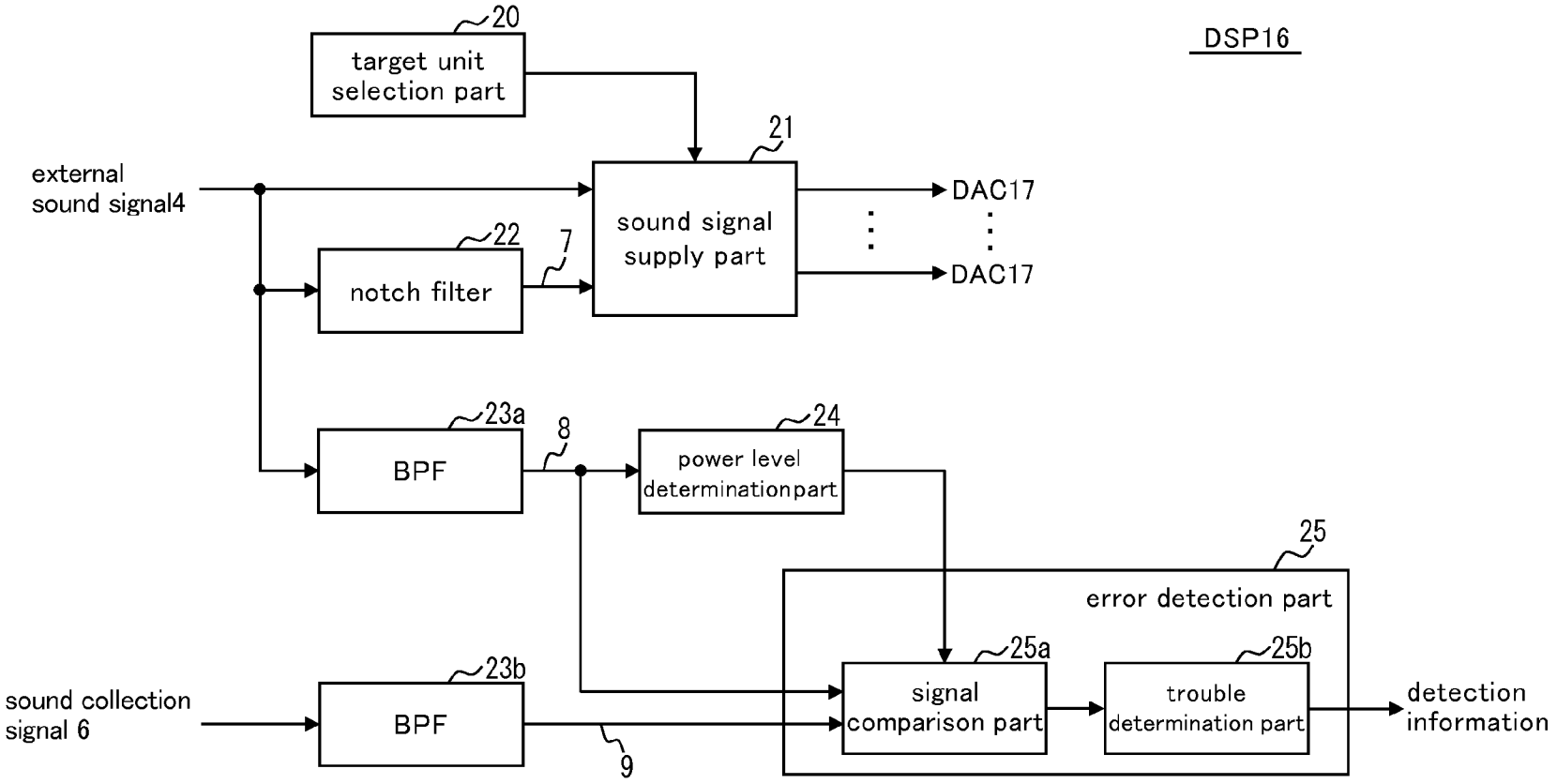
FIG. 3 is a block diagram illustrating an example of a functional configuration inside the DSP 16 in FIG. 2.

FIG. 3 is a block diagram illustrating an example of a functional configuration inside the DSP 16 in FIG. 2. This diagram illustrates the case of performing the failure detection on the speaker units 11 without interrupting sound emission based on the external sound signal 4. The DSP 16 is configured to include a target unit selection part 20, a sound signal a supply part 21, a notch filter 22, narrow BPFs (bandpass filters) 23*a* and 23*b*, a power level determination part 24, and an error detection part 25.

The target unit selection part 20 selects any one of the speaker units 11 as a target unit for the failure detection, and outputs a result of the selection to the sound signal supply part 21. The target unit selection part 20 sequentially selects the respective speaker units 11 as the target unit. The target unit is automatically selected in predetermined order, and every time the target unit is selected, the failure detection is performed. Here, speaker units 11 other than the target unit are referred to as non-target units.

The notch filter 22 is a band elimination filter that attenuates frequency components in a test band 26, and thereby generates a non-target sound signal 7 from the external sound signal 4. That is, the notch filter 22 eliminates the frequency components in the test band 26, and makes frequency components in bands other than the test band 26 pass.

The test band 26 is a predetermined frequency band for detecting the failure of the target unit, of which the center frequency and bandwidth are preliminarily determined depending on a sound range or frequency characteristic of the target unit. For example, the test band 26 has a narrow bandwidth, and the upper limit frequency within the band is approximately 10 times the lower limit frequency.

The narrow BPFs 23*a* and 23*b* are both bandpass filters adapted to attenuate the frequency components in the bands other than the test band 26. That is, the narrow BPFs 23*a* and 23*b* make the frequency components in the test band 26 pass, and eliminates the frequency components in the bands other than the test band 26.

The narrow BPF 23*a* attenuates the frequency components in the bands other than the test band 26 from the external sound signal 4, and thereby generates a reference sound signal 8 for making a comparison with the sound collection signal 6. The narrow BPF 23*b* attenuates the frequency components in the bands other than the test band 26, and thereby generates a detection sound signal 9 from the sound collection signal 6.

The sound signal supply part 21 supplies the external sound signal 4 to the target unit as well as supplying the non-target sound signal 7 to the non-target units. That is, from the target unit, a sound containing the frequency components in the test band 26 is emitted, whereas from the non-target units, sounds in which the frequency components in the test band 26 are attenuated are respectively emitted.

The error detection part 25 is configured to include a signal comparison part 25*a* and a failure determination part 25*b*, and on the basis of the detection sound signal 9 and the reference sound signal 8, detects the trouble of the target unit to provide an error output. The error detection part 25 detects the failure of the target unit using the fact that the frequency components in the test band 26 are emitted only from the target unit.

The signal comparison part 25*a* makes a comparison between the detection sound signal 9 and the reference sound signal 8, and outputs a result of the comparison to the failure determination part 25*b*. The comparison between the detection sound signal 9 and the reference sound signal 8 is made with respect to the sound collection signal 6 obtained during an output period of the non-target sound signal 7. The failure determination part 25*b* determines on the basis of the result of the comparison by the signal comparison part 25*a* whether or not failure occurs in the target unit, and outputs a result of the determination as detection information.

The power level determination part 24 makes a determination as to whether or not a power revel of the reference sound signal 8 is a certain level or more, and outputs a result of the determination to the signal comparison part 25*a*. For example, during a certain period, an amplitude level of the reference sound signal 8 is detected, and a peak of the amplitude level is compared with a predetermined threshold value. Alternatively, a time average of an amplitude level during a sampling period is compared with a predetermined threshold value. Specifically, it is determined whether or not the reference sound signal 8 is present having an amplitude level sufficient for background noise (surrounding noise) constantly collected through the sensor microphones 12.

The error detection part 25 performs the failure detection on the target unit in the case where the power level of the reference sound signal 8 is the certain level or more, and thereby prevents the failure of the target unit from being erroneously detected due to the background noise. That is, the signal comparison part 25*a* performs a process for the comparison between the detection sound signal 9 and the reference sound signal 8 on the basis of the result of the determination by the power level determination part 24.

For example, the signal comparison part 25*a* makes a comparison between an amplitude level of the detection sound signal 9 and the amplitude level of the reference sound signal 8. On the basis of a result of the determination, the failure determination part 25*b* determines the disconnection or short circuit of wiring between the DSP 16 and the target unit, trouble of a corresponding power amplifier 18, or trouble of the target unit itself.

Specifically, by counting the number of appearances of a peak of which an amplitude level exceeds a certain level, and determining whether or not the count is coincident between the detection sound signal 9 and the reference sound signal 8, the trouble of the target unit can be detected.

In the case where as the speaker units 11, a low tone unit and a high tone unit respectively having different sound ranges are provided, any of the notch filter 22 and the narrow BPFs 23*a* and 23*b* switches between a test band 26*w* included in the sound range of the low tone unit and a test band 26*t* included in the sound range of the high tone unit. The switching of the test band 26 is performed on the basis of a result of the target unit selection by the target unit selection part 20.

As described, by switching the test band 26 depending on a sound range of the target unit, failure can be detected even in the case where the target unit is any of the low tone unit and the high tone unit.

Figure 4:
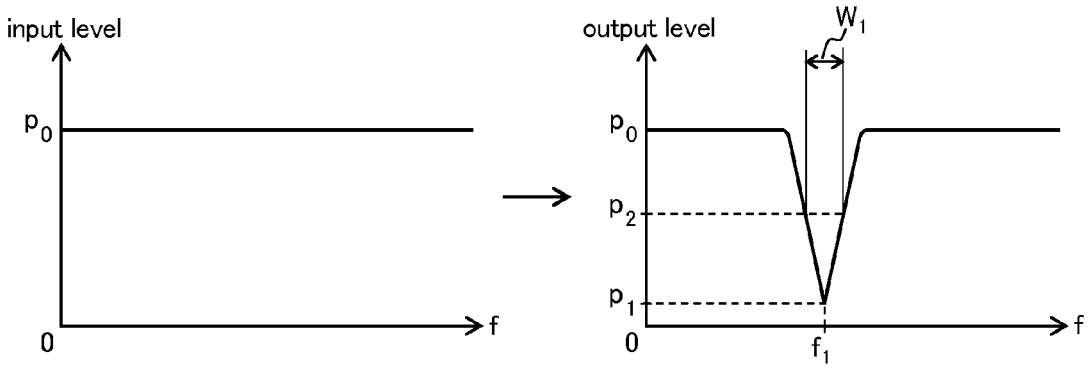
FIG. 4 is an explanatory diagram schematically illustrating an example of actions of the notch filter 22 and the narrow BPF 23*a* or 23*b* in FIG. 3.
Figure 4:
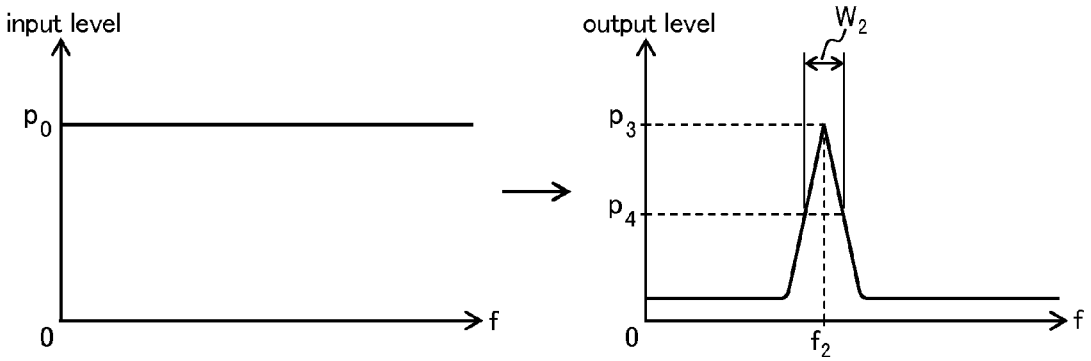

FIG. 4 is an explanatory diagram schematically illustrating an example of actions of the notch filter 22 and the narrow BPF 23*a* or 23*b* in FIG. 3. (*a*) in the diagram illustrates the case of the notch filter 22, and (*b*) illustrates the case of the narrow BPF 23*a* or 23*b*. The diagram illustrates frequency characteristics including a frequency-dependent power level with the horizontal axis representing a frequency and the vertical axis representing a power level.

In the case of the notch filter 22, when inputting a sound signal of which a frequency-dependent power level has a substantially constant value $p_0$, a sound signal of which only the frequency components in the test band 26 are attenuated is outputted. Given that the center frequency of the test band 26 is $f_1$, and a power level of the output signal at the frequency $f_1$ is $p_1$, the bandwidth of the test band 26 is provided by a frequency range $w_1$ where a power level of the output signal is $p_2=p_1+3$ dB.

On the other hand, in the case of the narrow BPF 23*a* or 23*b*, when inputting a sound signal of which a frequency-dependent power level has a substantially constant value $p_0$, a sound signal of which the frequency components in the bands other than the test band 26 are attenuated is outputted. Given that the center frequency $f_2$ of the test band 26 is $f_2=f_1$, and a power level of the output signal at the frequency $f_2$ is $p_3$, the bandwidth of the test band 26 is provided by a frequency range $w_2$ where a power level of the output signal is $p_4=p_3-3$ dB. $w_2$ is substantially coincident with $w_1$.

By using the notch filter 22 having such frequency characteristics, the sound containing the frequency components in the test band 26 can be emitted from the target unit, whereas from the non-target units, sounds of which the frequency components in the test band 26 are attenuated can be respectively emitted. Also, by using the narrow BPFs 23*a* and 23*b*, the reference and detection sound signals 8 and 9 of which the frequency components in the bands other than the test band 26 are attenuated are generated respectively from the external sound signal 4 and the sound collection signal 6. That is, by making a comparison between the test band 26 of the external sound signal 4 and that of the sound collection signal 6, the failure detection is performed, and therefore the failure of a speaker unit 11 can be detected without interrupting the emission of broadcast sound based on the external sound signal 4.

According to the present embodiment, since the sensor microphones 12 are arranged in the speaker housing 10 in which the multiple speaker units 11 are arranged, the failure of a speaker unit 11 can be detected by collecting sounds emitted from the speaker units 11 with the sensor microphone 12.

Specifically, the failure of the target unit is detected using the fact that when supplying the external sound signal 4 and the non-target sound signal 7 to the speaker units 11, the frequency components in the test band 26 are emitted only from the target unit. Accordingly, without interrupting broadcasting, the failure of a speaker unit 11 can be detected. Also, the frequency components in the bands other than the test band 26 are emitted from the respective speaker units 11, and therefore the failure of a speaker unit 11 can be detected with the quality of broadcast sound being suppressed from deteriorating.

Note that in the present embodiment, described is the example of the case where any one of the speaker units 11 is selected as the target unit, and every time the target unit is selected, the failure detection is performed; however, the present invention is not limited to such a configuration. For example, a configuration where by selecting multiple speaker units 11 as target units, and making a test band 26 different for each of the speaker units 11 as the target units, failure detection is performed simultaneously on the multiple speaker units 11 is also possible. That is, in this configuration, the test band is assigned for each of the target units.

Embodiment 2

In Embodiment 1, described is the example of the case where without interrupting sound emission based on the external sound signal 4, the failure detection is performed on the speaker units 11. On the other hand, in the present embodiment, described is the case where failure detection is performed on speaker units 11 using a test impulse signal.

Figure 5:
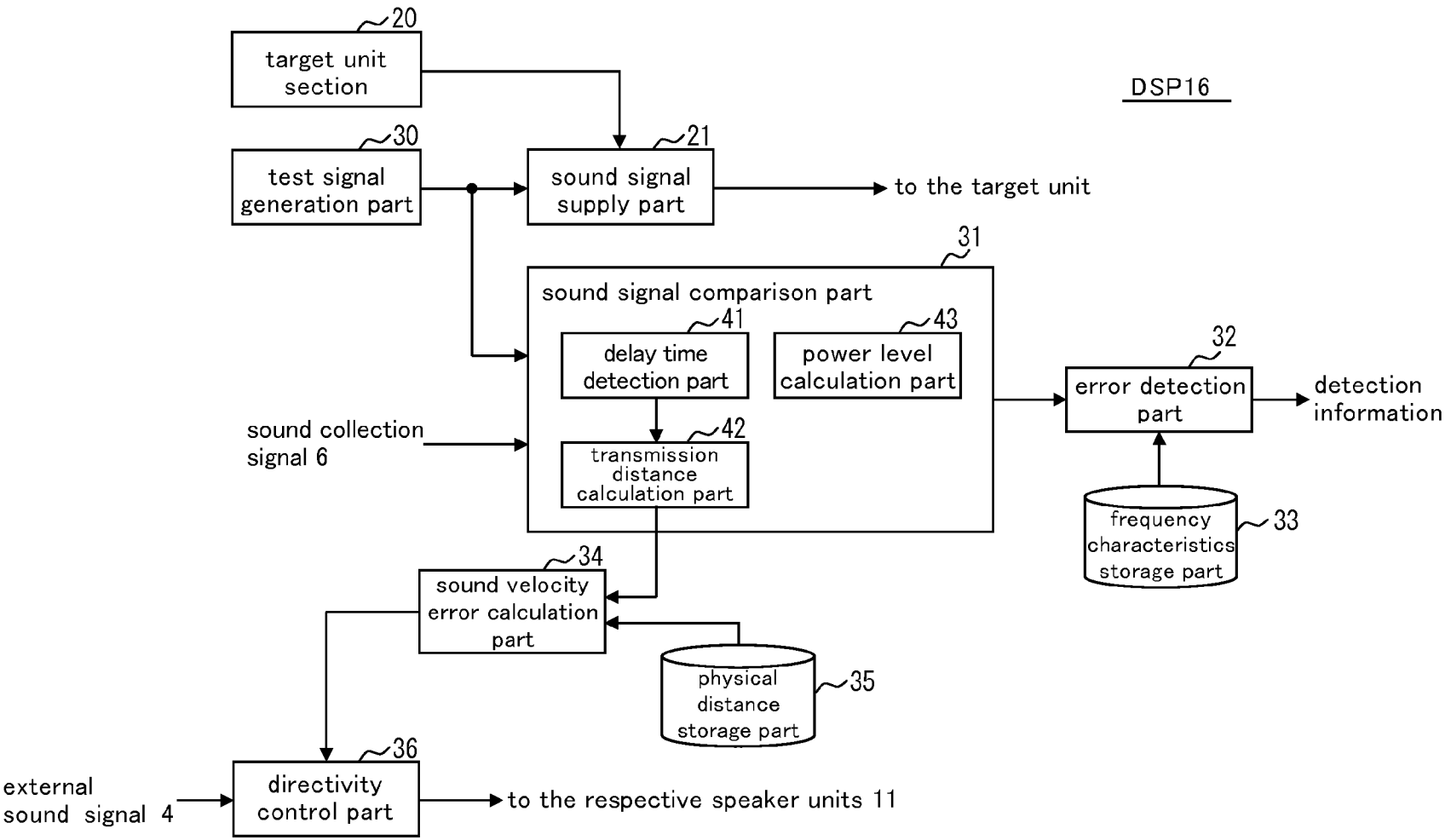
FIG. 5 is a block diagram illustrating a configuration example of an array speaker apparatus 1 according to Embodiment 2 of the present invention, in which an example of a functional configuration inside a DSP 16 is illustrated.

FIG. 5 is a block diagram illustrating a configuration example of an array speaker apparatus 1 according to Embodiment 2 of the present invention, in which an example of a functional configuration inside a DSP 16 is illustrated. The DSP 16 is configured to include a target unit selection part 20, a sound signal supply part 21, a test signal generation part 30, a sound signal comparison part 31, an error detection part 32, a frequency characteristics storage part 33, a sound velocity error calculation part 34, a physical distance storage part 35, and a directivity control part 36.

It is here assumed that the DSP 16 switches between a loudspeaker mode and a measurement mode on the basis of an input signal from an unillustrated operation part. The loudspeaker mode is an operation mode in which an external sound signal 4 inputted to a broadcast terminal 13 is emitted from respective speaker units 11. On the other hand, the measurement mode is an operation mode in which the test impulse signal is emitted from a target unit to measure an impulse response.

In the measurement mode, the target unit selection part 20 selects any one of the speaker units 11 as the target unit for failure detection, and outputs a result of the selection to the sound signal supply part 21. For example, the target unit is sequentially selected at regular time intervals TI. For example, the time interval TI is approximately 100 ms.

The test signal generation part 30 generates the test impulse signal, and outputs the test impulse signal to the sound signal supply part 21 and the sound signal comparison part 31. The test impulse signal is an input sound signal for detecting the failure of the target unit, and has a predetermined time length T1 from the rise from a non-signal state to the fall to the non-signal state. For example, a pulsed signal containing various frequency components in an audio band is generated as the test impulse signal.

Here, a sweep signal having a time length T1 of approximately several ms is used as the test impulse signal. The sweep signal is a sine wave signal of which a frequency continuously increases within the time interval T1. For example, the time length T1 and amplitude level of the test impulse signal, a variation range within which the frequency is varied within the time length T1, and the upper and lower limit frequencies are determined in advance depending on a sound range or frequency characteristic of the target unit.

The sound signal supply part 21 supplies the test impulse signal inputted from the test signal generation part 30 to the target unit. The sound signal comparison part 31 is configured to include a delay time detection part 41, a transmission distance calculation part 42, and a power level calculation part 43, and makes a comparison between the test impulse signal and a sound collection signal 6 to output a result of the comparison to the error detection part 32. The comparison between the test impulse signal and the sound collection signal 6 is made with the test impulse signal and the sound collection signal 6 being synchronized with each other.

The delay time detection part 41 detects a delay time T2 of an impulse response to the test impulse signal on the basis of the sound collection signal 6 in order to detect miswiring to the target unit, and outputs a result of the detection to the transmission distance calculation part 42. The transmission distance calculation part 42 obtains a sound wave transmission distance Ld between the target unit and a sensor microphone 12 on the basis of the delay time T2 detected by the delay time detection part 41. The sound wave transmission distance Ld is obtained from $Ld=V\times T2$, using the velocity of sound V.

The power level calculation part 43 performs a Fourier transformation of the sound collection signal 6 to obtain a frequency-dependent power level in order to detect the trouble of the target unit itself. For example, by performing a fast Fourier transformation of amplitude data on the sound collection signal 6 obtained during a certain period, frequency characteristics including a frequency-dependent power level can be obtained.

On the basis of a result of the comparison by the sound signal comparison part 31, the error detection part 32 detects the trouble of the target unit, and provides an error output. Specifically, on the basis of the sound wave transmission distance Ld, miswiring to the target unit is detected, and a result of the detection is outputted as detection information. That is, by comparing a distance between a unit attachment position on a speaker housing 10, which corresponds to a channel to be connected with the target unit, and the sensor microphone 12 with the sound wave transmission distance Ld, misconnection between the DSP 16 and the target unit is detected.

In the case of attaching the sensor microphone 12 to an arbitrary position of the speaker housing 10, the attachment position of the target unit may not be able to be specified from the sound wave transmission distance Ld depending on the attachment position of the sensor microphone 12. On the other hand, in the present embodiment, the sensor microphone 12 is arranged in the extension of an array of the speaker units 11, and therefore even in the case where the target unit is any of the speaker units 11, the attachment position of the target unit can be specified from the sound wave transmission distance Ld.

The frequency characteristics storage part 33 retains the frequency characteristics of the target unit. The frequency characteristics are impulse response characteristics of the target unit, and include a frequency-dependent power level. The frequency characteristics storage part 33 retains frequency characteristics preliminarily measured on all of the speaker units 11.

The error detection part 32 makes a comparison between the frequency-dependent power level obtained by the power level calculation part 43 and the frequency characteristics retained in the frequency characteristics storage parts 33, and on the basis of a result of the comparison, performs the failure detection on the target unit. This makes it possible to accurately recognize a state of the target unit, and detect the trouble of a diaphragm such as a tear of cone paper, deterioration in sound quality, or change in sound range.

The error detection part 32 can detect misconnection such as the target unit being connected to wrong polarity, on the basis of the polarity of an impulse response to the test impulse signal. Also, on the basis of the presence or absence of an impulse response, disconnection or short circuit of wiring between the DSP 16 and the target unit, or trouble of the corresponding power amplifier 18 can be detected.

The physical distance storage part 35 retains a physical distance Lb between the target unit and the sensor microphone 12. Physical distances Lb are actual distances between the speaker units 11 and the sensor microphone 12, and used to make a comparison with the sound wave transmission distance Ld estimated from the velocity V of sound and the delay time T2 . The physical distance storage part 35 preliminarily retains the physical distances Lb regarding all of the speaker units 11, and the sound velocity error calculation part 34 obtains a sound velocity error VE on the basis of the difference between the sound transmission distance Ld and the physical distance Lb. The sound velocity error VE can be obtained by dividing an absolute value of (Ld−Lb) by the delay time T2 of the impulse response.

In the loudspeaker mode, the directivity control part 36 supplies the external sound signal 4 to the respective speaker units 11 as well as adjusting a delay time of the external sound signal 4 for each of the speaker units 11. The delay time adjustment is performed so as to make a phase difference between adjacent speaker units 11 equal to a desired value.

In order to obtain desired directivity, the directivity control part 36 performs an action to correct the delay time for each of the speaker units 11 on the basis of the sound velocity error VE obtained by the sound velocity calculation part 34 in the measurement mode. That is, the phase difference between adjacent speaker units 11 is adjusted using the sound velocity error VE.

Figure 6:
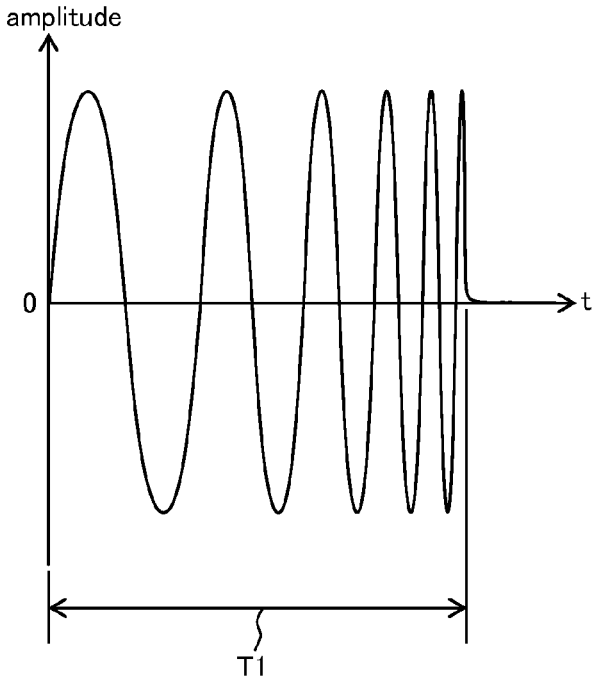
FIG. 6 is an explanatory diagram schematically illustrating an example of the action of the DSP 16 in FIG. 5.
Figure 6:
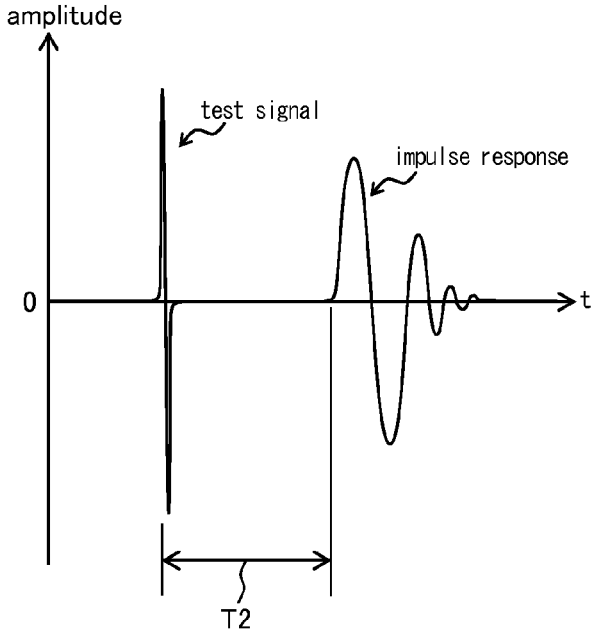

FIG. 6 is an explanatory diagram schematically illustrating an example of the action of the DSP 16 in FIG. 5, and (a) in the diagram illustrates the test signal, whereas (b) illustrates an impulse response to the test signal. The diagram illustrates signal waveforms with the horizontal axis representing time and the vertical axis representing amplitude.

The test signal is a sweep signal, of which a frequency gradually increases within the time length T1 with fixed amplitude being kept. On the other hand, the impulse response is represented by a response signal that is collected with the sensor microphone 12 when emitting the test signal from the target unit, which is a decay signal of which amplitude gradually decreases.

Detecting such a time delay of the impulse response, i.e., detecting the delay time T2 of the impulse response to the test signal makes it possible to detect miswiring to the target unit. Also, comparing the polarity of the impulse response with the test signal makes it possible to determine whether or not the target unit is connected having correct polarity.

Figure 7:
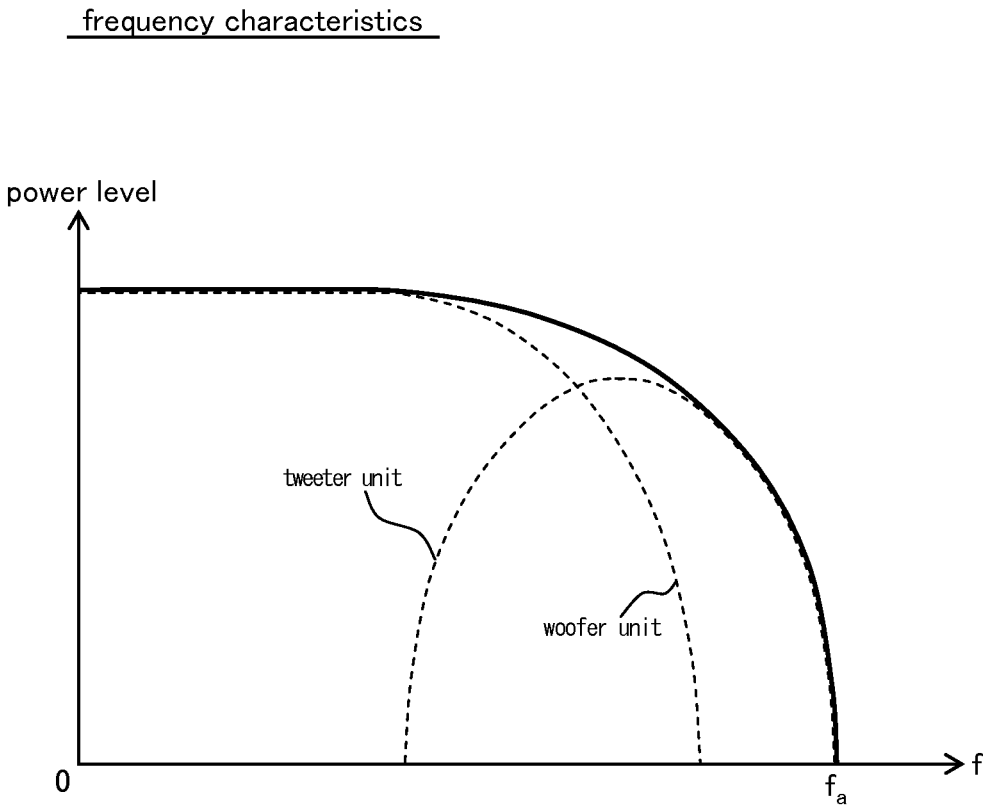
FIG. 7 is a diagram illustrating an example of frequency characteristics of a speaker unit 11, in which a frequency-dependent power level is illustrated.

FIG. 7 is a diagram illustrating an example of frequency characteristics of a speaker unit 11, in which a frequency-dependent power level is illustrated. This diagram illustrates preliminarily measured frequency characteristics with the horizontal axis representing a frequency and the vertical axis representing a power level.

The frequency characteristics of the speaker unit 11 are provided by the structure or material of a diaphragm, structure of the speaker housing 10, or the like. Regarding a characteristic curve representing the frequency characteristics, as the frequency is increased, the power level gradually decreases, and near a cutoff frequency fa, sharply decreases.

Comparing such frequency characteristics with the frequency characteristics obtained by emitting the test signal in the measurement mode makes it possible to detect the trouble of the target unit itself. In particular, between a woofer unit and a tweeter unit, a sound range is different, and a characteristic curve is very different, and therefore it can be detected whether or not the woofer unit or the tweeter unit is correctly connected, or a sound level or a sound range is normal.

According to the present embodiment, the delay time T2 of the impulse response to the test impulse signal is detected, and from the delay time T2 , the sound wave transmission distance Ld between the target unit and the sensor microphone 12 is obtained to detect miswiring to the target unit. That is, by specifying the position of the target unit on the speaker housing 10 from the sound wave transmission distance Ld, misconnection such as a speaker unit 11 being connected to a wrong channel can be detected.

Also, when the delay time of the external sound signal 4 is adjusted for each of the speaker units 11, the delay time is corrected by obtaining the sound velocity error VE from the difference between the sound wave transmission distance Ld obtained by emitting the test signal from the target unit and the physical distance Lb between the target unit and the sensor microphone 12, and therefore the accuracy of directivity control can be improved.

Note that in the present embodiment, described is the example of the case where any one of the speaker units 11 is selected as the target unit, and every time the target unit is selected, the failure detection is performed; however, the present invention is not limited to such a configuration. For example, a configuration where by selecting multiple speaker units 11 as target units, and making the target units respectively output impulse signals, failure detection is performed simultaneously on the multiple speaker units 11 is also possible. Specifically, sound wave transmission distances Ld are obtained for the target units from impulse responses to the impulse signals, respectively, and compared with corresponding physical distances Lb. Then, by determining for all of the target units whether or not the sound wave transmission distances Ld and the corresponding physical distances Lb are coincident with each other, the failure detection is performed on the respective target units.

Also, in Embodiments 1 and 2, described is the example of the case where the DSP 16 provided inside the speaker housing 10 performs the failure detection; however, the present invention can also be applied to the case where a controller separated from the speaker housing 10 performs failure detection.

Further, in Embodiments 1 and 2, described is the example of the case where the present invention is applied to the array speaker apparatus 1 in which the three or more speaker units 11 are provided in the speaker housing 10; however, the present invention can also be applied to a speaker apparatus including two speaker units 11.

DESCRIPTION OF REFERENCE NUMERALS

100 sound amplification system
1 array speaker apparatus
10 speaker housing
11 speaker unit
12 sensor microphone
13 broadcast terminal
14, 15 ADC
16 DSP
17 DAC
18 power amplifier
20 target unit selection part
21 sound signal supply part
22 notch filter
23*a*, 23*b* BPF
24 power level determination part
25 error detection part
25*a* signal comparison part
25*b* trouble determination part
26 test band
30 test signal generation part
31 sound signal comparison part
32 error detection part
33 frequency characteristic storage part
34 sound velocity error calculation part
35 physical distance storage part
36 directivity control part
41 delay time detection part
42 transmission distance calculation part
43 power level calculation part
2 signal source
3 amplifier
4 external sound signal
5 speaker drive signal
6 sound collection signal
7 non-target sound signal
8 reference sound signal
9 detection sound signal

The invention claimed is:

1. A speaker apparatus comprising:

two or more speaker units that are arranged in a speaker housing;

a sensor microphone that is arranged in said speaker housing and outputs a sound collection signal; and a processor configured to:

select at least one of said speaker units as a target unit;

supply an input sound signal to said target unit;

provide an error output on a basis of said input sound signal and said sound collection signal;

serve as a band elimination filter that attenuates a frequency component in a test band, and thereby generates a non-target sound signal from said input sound signal;

supply said non-target sound signal to speaker units other than said target unit;

serve as a first bandpass filter that attenuates a frequency component in a band other than said test band, and thereby generates a reference sound signal from said input sound signal; and serve as a second bandpass filter that attenuates the frequency component in the band other than said test band, and thereby generates a detection sound signal from said collection signal, wherein said error output is provided on a basis of a result of a comparison between said detection sound signal and said reference signal.

2. The speaker apparatus according to claim 1, wherein the processor is configured further to:

make a determination as to whether or not a power level of said reference sound signal is a certain level or more, and wherein said error output is provided on a basis of a result of the determination.

3. The speaker apparatus according to claim 1, comprising a low tone unit and a high tone unit as said speaker units, the low and high tone units respectively having different sound ranges, wherein any of said band elimination filter, said first bandpass filter, and said second bandpass filter can switch between a first test band included in the sound range of said low tone unit and a second test band included in the sound range of said high tone unit, and on a basis of a result of selecting said target unit, switches between the first and second test bands.

4. A speaker apparatus, comprising:

two or more speaker units that are arranged in a speaker housing;

a sensor microphone that is arranged in said speaker housing and outputs a sound collection signal;

an external input terminal to which an external sound signal is input; and a processor configured to:

select at least one of said speaker units as a target unit;

supply an input sound signal to said target unit;

provide an error output on a basis of said input sound signal and said sound collection signal;

generate a test impulse signal as said input sound signal;

detect a delay time of an impulse response to said test impulse signal on a basis of said sound collection signal;

obtain a sound wave transmission distance between said target unit and said sensor microphone on a basis of said delay time;

supply said external sound signal to said speaker units and also adjusts a delay time of said external sound signal for each of said speaker units;

retain a physical distance between said target unit and said sensor microphone; and obtain a sound velocity error on a basis of a difference between said sound wave transmission distance and said physical distance, wherein said error output is provided on a basis of said sound wave transmission distance, and said delay time is corrected on a basis of said sound velocity error.

5. A speaker apparatus, comprising:

two or more speaker units that are arranged in a speaker housing;

a sensor microphone that is arranged in said speaker housing and outputs a sound collection signal; and a processor configured to:

select at least one of said speaker units as a target unit;

supply an input sound signal to said target unit;

provide an error output on a basis of said input sound signal and said sound collection signal;

generate a test impulse signal as said input sound signal;

detect a delay time of an impulse response to said test impulse signal on a basis of said sound collection signal;

obtain a sound wave transmission distance between said target unit and said sensor microphone on a basis of said delay time;

perform a Fourier transformation of said sound collection signal to obtain a frequency-dependent power level; and as an impulse response characteristic of said target unit with respect to said impulse signal, retain a frequency characteristic including a frequency-dependent power level, wherein said error output is provided on a basis of said sound wave transmission distance and a comparison between the obtained frequency-dependent power level and said frequency characteristic.

* * * * *